United States Patent [19]

Aschberger et al.

[11] 4,059,186

[45] Nov. 22, 1977

[54] CAN BODY SHAPER

[75] Inventors: Anton A. Aschberger, Oak Lawn; Jack L. Avery, Park Forest; William J. Cartwright, Palos Park; Geoffrey J. Dean, Rockton; Oliver J. Tysver, Chicago Heights; Robert W. Wolfe, Oak Lawn; Frederick H. Bautz, Hazel Crest, all of Ill.

[73] Assignee: The Continental Group, Inc., New York, N.Y.

[21] Appl. No.: 400,499

[22] Filed: Sept. 25, 1973

Related U.S. Application Data

[62] Division of Ser. No. 221,587, Jan. 28, 1972, Pat. No. 3,807,209.

[51] Int. Cl.[2] ..... B65G 47/00

[52] U.S. Cl. ..... 198/481; 198/690

[58] Field of Search ..... 198/25, 209, 210, 481, 198/480, 690

[56] References Cited

U.S. PATENT DOCUMENTS

| | | | |
|---|---|---|---|
| 2,275,978 | 3/1942 | Mingle | 198/209 |
| 3,659,694 | 5/1972 | Harris | 198/25 |

*Primary Examiner*—Evon C. Blunk
*Assistant Examiner*—Douglas D. Watts
*Attorney, Agent, or Firm*—Diller, Brown, Ramik & Wight

[57] ABSTRACT

This disclosure relates to a machine for receiving can bodies and automatically outwardly expanding the same to a decorative predetermined contour. The machine includes special transfer means for positioning can bodies on and removing can bodies from supports moving in a convex arcuate path, the transfer device including a turret member mounted for rotation about a fixed axis, a plurality of article carriers pivotally carried by the turret member for movement therewith in a generally circular path, and control means for controlling the contour of a portion of the generally circular path to be coincident with a portion of the arcuate path.

2 Claims, 6 Drawing Figures

FIG.5
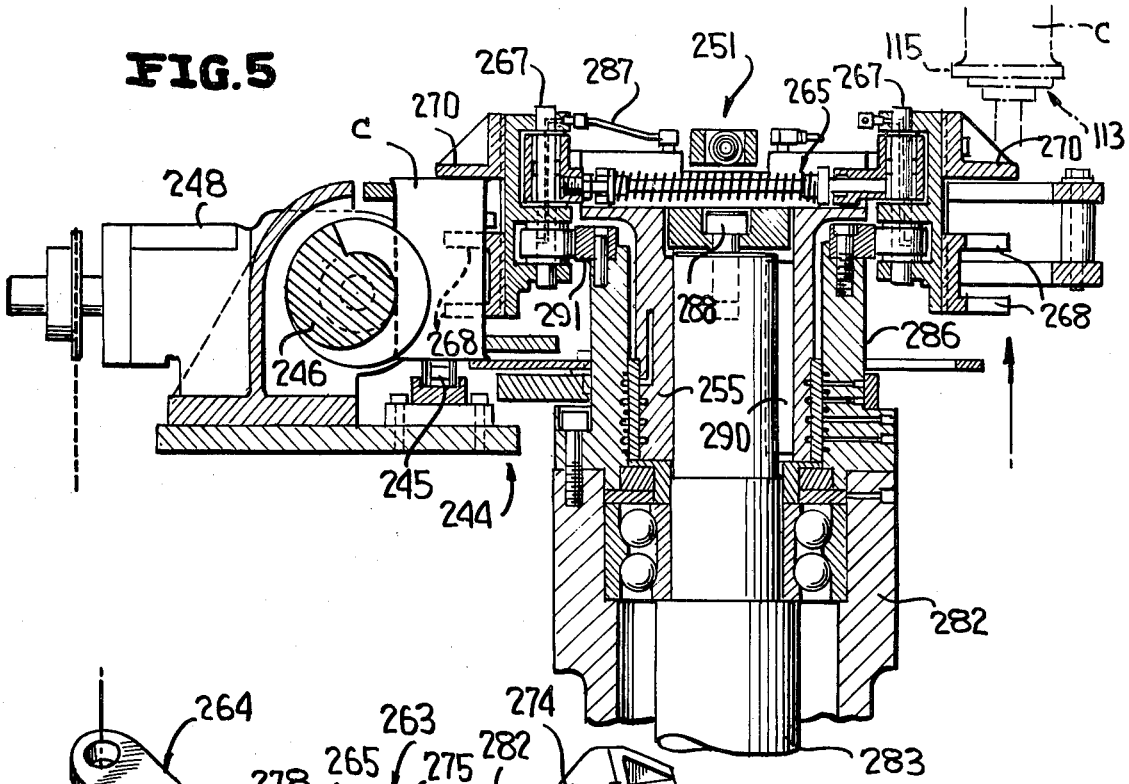
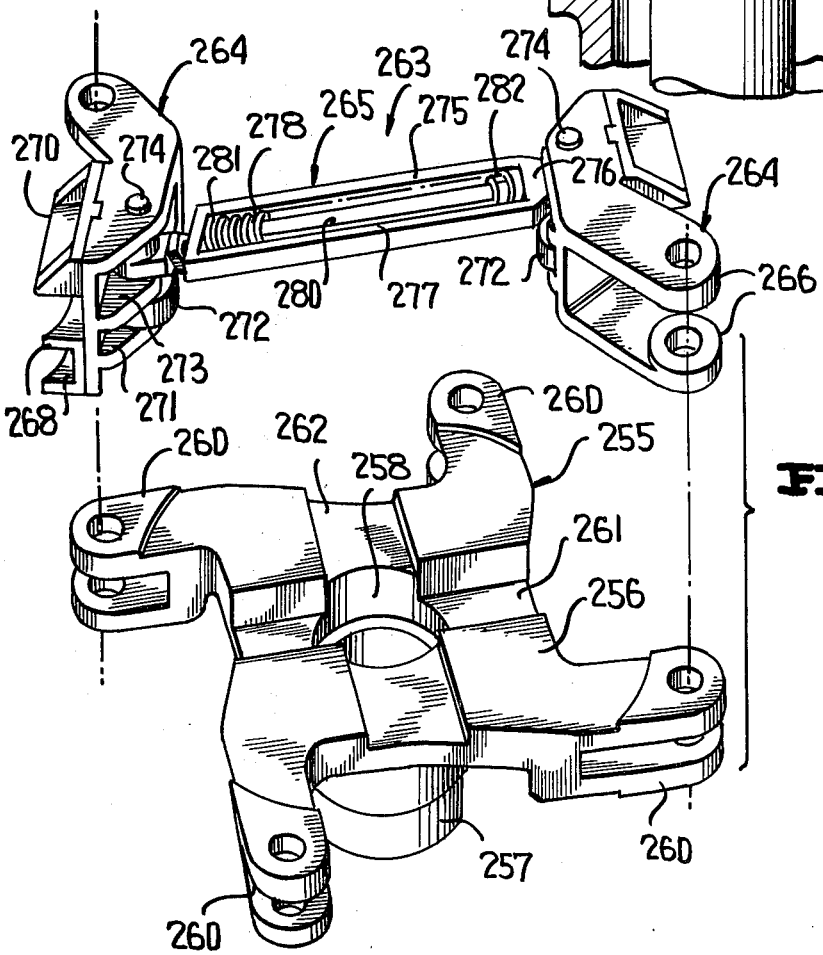
FIG.6

CAN BODY SHAPER

This is a division of Ser. No. 221,587, filed Jan. 28, 1972 now U.S. Pat. No. 3,807,209, granted Apr. 30, 1974.

This invention relates in general to new and useful improvements in machines for manufacturing can bodies, and more particularly to a machine for changing the contour of can bodies so as to have an ornamental appearance.

BACKGROUND OF THE INVENTION

In recent years there has been a trend towards the production of stylized can bodies. Numerous efforts have been made to reshape can bodies from their original cylindrical configuration to a preselected ornamental configuration on a commercial basis. Despite the tremendous efforts set forth by numerous interested parties, all efforts to date have resulted in machines in operations wherein the production is very poor and is not truly commercially feasible except with respect to can bodies for highly specialized articles wherein a very high price can be paid for the can body.

SUMMARY OF THE INVENTION

A principal feature of this invention is to provide a machine for shaping can bodies wherein the machine is operable on a commercial basis sufficiently economically to be utilized in conjunction with relatively inexpensive cans, such as those used in the packaging of beverages.

It is to be understood that the shaping units are mounted on a frame for rotation along a predetermined circular path. It is, therefore, necessary to transfer can bodies to and from the support members while the support members are moving in a circular path. If one utilizes a conventional turret for such transfer, the path of the turret coincides with the path of the support members only at a single point. This is insufficient for an accurate transfer. Accordingly, a feature of this invention is the provision of a novel transfer mechanism which, while it moves in a generally circular path, has means for varying the shape of the path so that the path of a can body carried by the transfer device coincides with the path of the support members for a relatively great extent so that proper transfer of can bodies from the transfer device to the support members is assured.

With the above and other objects in view that will hereinafter appear, the nature of the invention will be more clearly understood by reference to the following detailed description, the appended claims and the several views illustrated in the accompanying drawings:

IN THE DRAWINGS

FIG. 5 is a fragmentary vertical sectional view taken generally along the line 5—5 of FIG. 4 and shows specifically the details of one of the transfer devices.

FIG. 6 is an enlarged exploded perspective view of the principal elements of one of the transfer devices.

Figure 1:
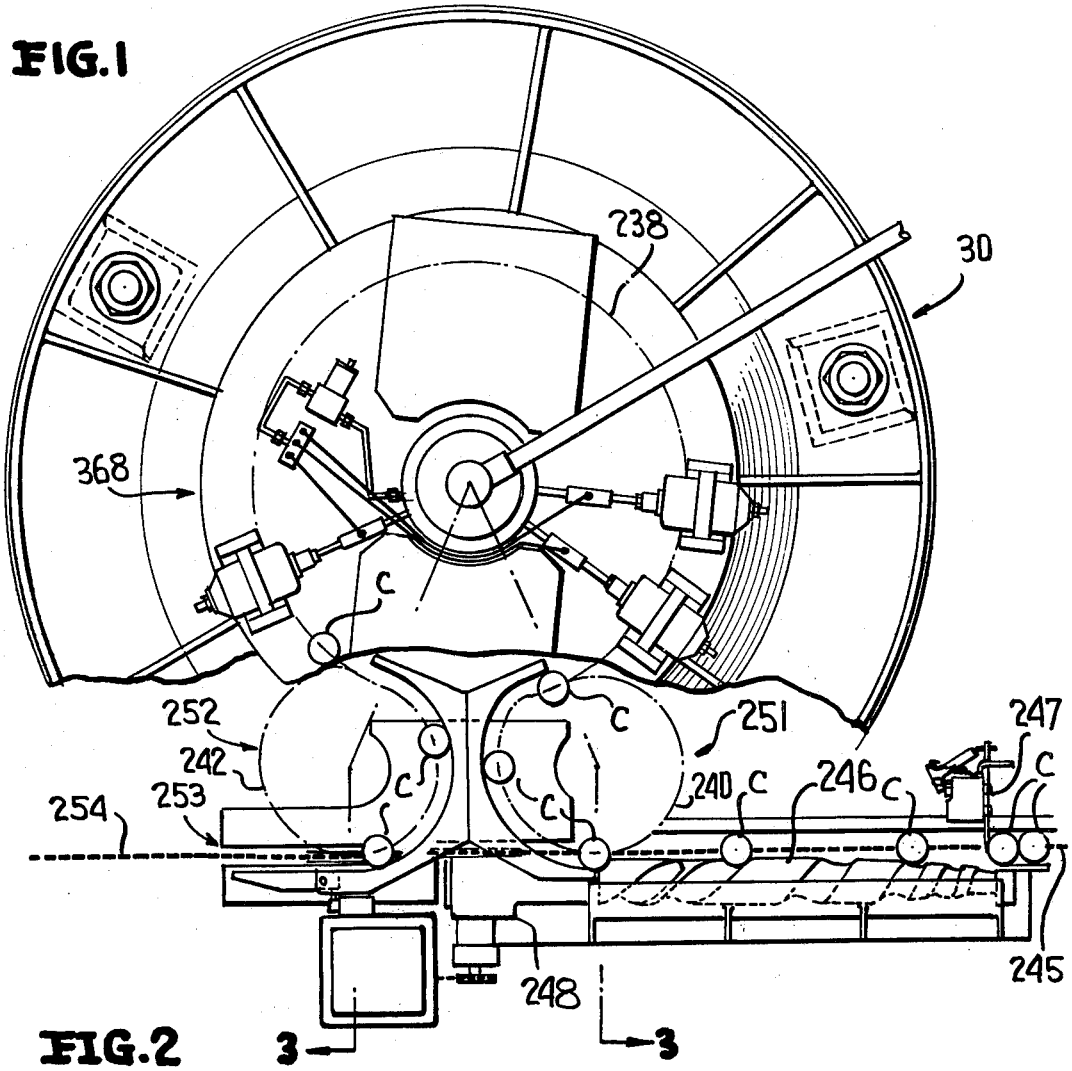
FIG. 1 is a plan view of the machine with parts broken away and shows schematically the infeed and outfeed of the machine.

Referring now to the drawings in detail, it will be seen that the machine is identified by the numeral 30 and includes a base, generally identified by the numeral 31. The base 31 is provided with suitable supports 32 for mounting the same in an elevated position with respect to a supporting floor (not shown). The machine 30 also includes a head structure 33 which is supported from the base 31 by means of a plurality of circumferentially spaced standards 34.

The base 31, among other structural features, includes a ring-like support member 35 carrying a bearing assembly 36. The head structure 33 also inclues a ring-like support member 37 which carries a bearing 38. The bearings 36 and 38, in turn, support for rotation a central frame, which is generally identified by the numeral 40, and which is of a fabricated construction. It is to be noted that the central frame 40 is constructed without the usual center shaft which supports the same. Basically, the central frame 40 is of a tubular construction and in of itself defines a large diameter shaft so as to have sufficient rigidity.

The frame 40 has mounted on the exterior surface thereof in circumferentially spaced relation a plurality of vertically extending body shapers, each body shaper being generally identified by the numeral 41. Each body shaper 41 includes basically a mold unit, generally identified by the numeral 42, a tool pack, generally identified by the numeral 43, and an orientation mechanism, generally identified by the numeral 44.

At this time it is pointed out that can bodies are presented to the mold units 42 by means of body supports, generally identified by the numeral 113. Each tool pack 43 is in vertical alignment with an associated body support 113 and each body support 113 includes a platen 115 on which a can body C is positioned for insertion in the respective tool pack.

TRANSFER ASSEMBLY

Figure 2:
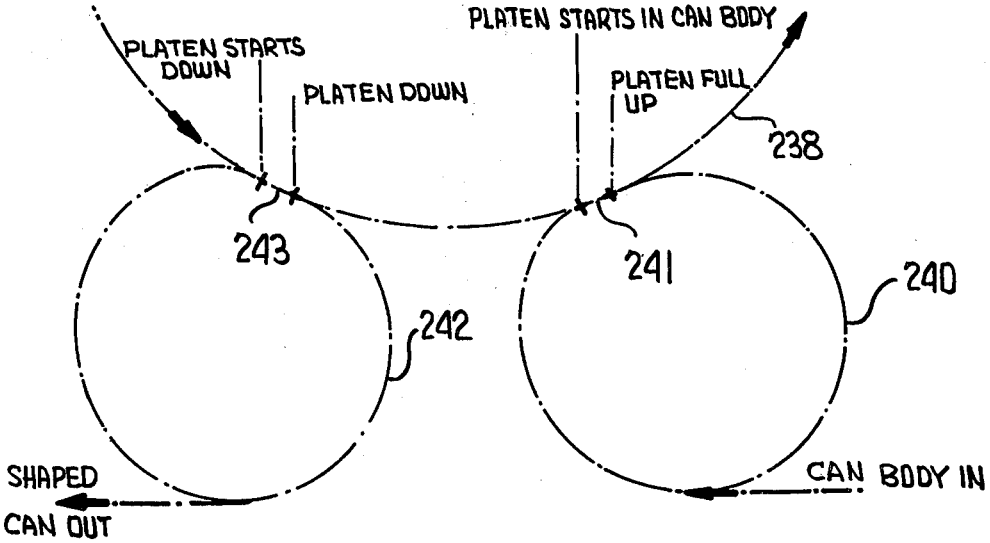
FIG. 2 is a schematic showing generally the transfer relationship and can body support vertical positions.

Referring now to FIGS. 1 and 2, it will be seen that the platens 115 move about a circular path and this path is identified in FIG. 2 by the numeral 238. A normal infeed turret would move a can body in a circular path which would be coextensive with the path 238 at a single point. The same is true of the path of movement of a can body of an outfeed turret. As a result, it is necessary that indexing occurs at the time of transfer. However, in accordance with this invention, indexing is eliminated and the platens 115 constantly move along the path 238 during the transfer of can bodies to and from the platens. This is accomplished by providing an infeed transfer device having a can body path of movement which is modified from a true circle. This path of movement of the infeed transfer device is identified by the numeral 240 and while a major portion thereof may be circular, the can body path of movement 240 is modified as at 241 so as to be circular, but along the path of movement 238 so that the two paths of movement are coextensive for a relatively long period of time, which period of time is sufficient for the transfer of a can body to the platen 115.

In a like manner, in accordance with this invention, there is provided an outfeed transfer device having a path of movement 242 which is primarily circular, but has a portion thereof deviating from a true circle with a part of that deviated portion as at 243 being circular, but coextensive with the path of movement 238. Thus, when shaped can bodies are to be transferred from the platens 115, the path of movement of the platens 115 will be coextensive with the path of movement of packets of the outfeed transfer device sufficiently long for the transfer to be effected.

Figure 4:
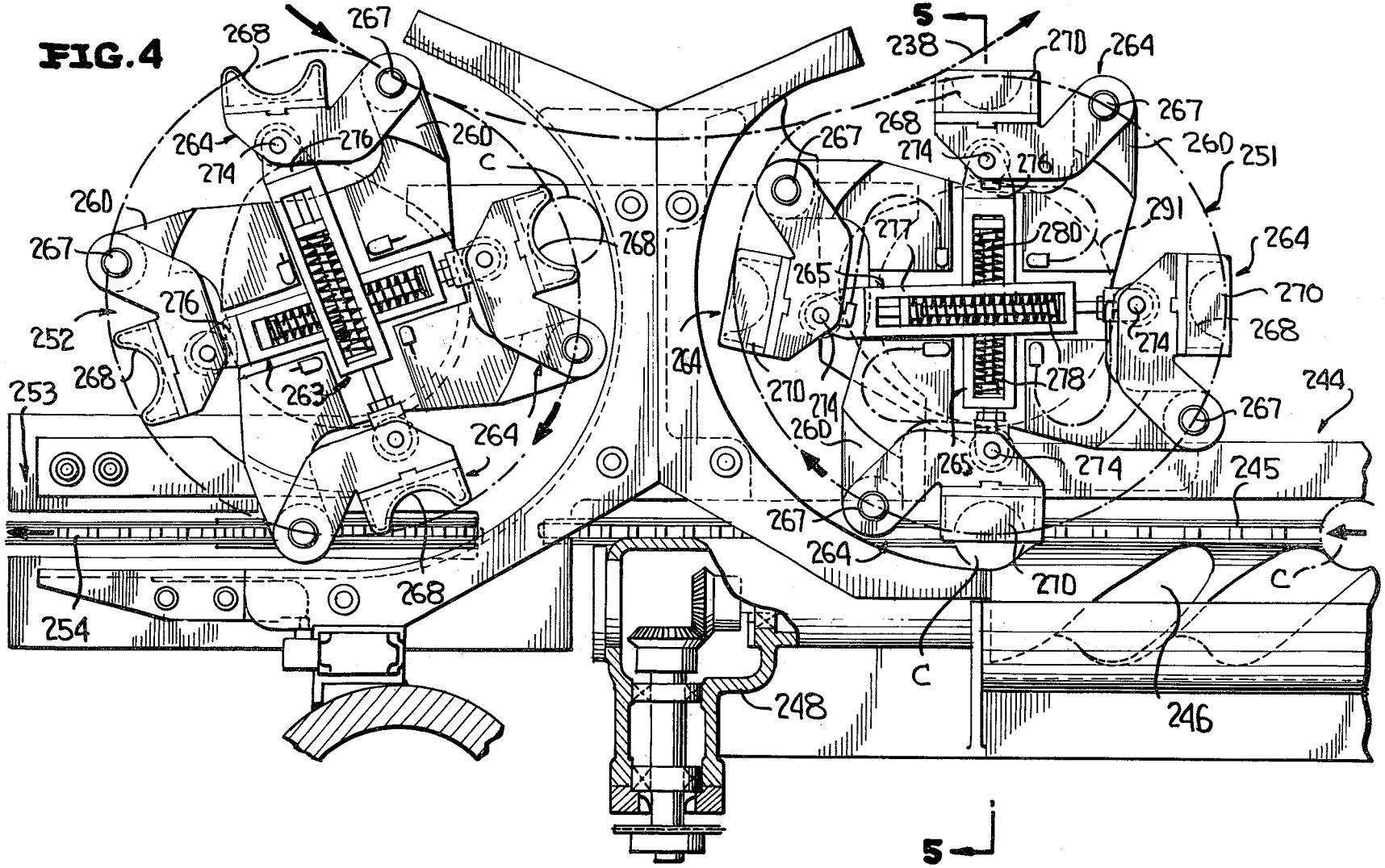
FIG. 4 is an enlarged plan view of the transfer units of the machine and shows specifically the details thereof.

Referring now to FIGS. 1 and 4, it will be seen that at the front of the machine 30 there is a combined guide and infeed assembly which is identified by the numeral 244. The assembly 244 includes a constantly moving conveyor chain 245 on which can bodies C seat and which moves the can bodies C towards the machine 30 along a straight line, but at no predetermined spacing. Along that portion of the endless conveyor 245 which is generally in front of the machine 30, a feed screw 246 is provided. In advance of the feed screw is an escapement mechanism 247 which allowed one can body C to be delivered to the feed screw 246 at a time, generally in accordance with the demands of the machine 30. The feed screw 246 automatically assures the spacing of the can bodies C in accordance with the requirements of the machine 30. The feed screw 246 is driven by means of a right angle drive mechanism 248 in a manner to be described hereinafter.

Can bodies C moving at a predetermined rate and at a predetermined spacing are received by an infeed transfer device generally identified by the numeral 251, and are delivered to the platens 115.

After the desired shaping of the can bodies has been effected, the shaped can bodies are removed from the platens 115 by an outfeed transfer device, generally referred to by the numeral 252. The transfer device 252 delivers the shaped can bodies to a second combined guide and feed assembly, generally identified by the numeral 253 which also moves the can bodies in a straight line. This assembly includes an endless conveyor 254 on which the can bodies are seated and which move the can bodies to the left as viewed in FIGS. 1 and 4.

It is to be understood that the transfer devices 251 and 252 are of substantially identical construction, and therefore, only a transfer device 251 will be described in detail here.

Reference is first made to FIG. 6 wherein there is illustrated the essential components of the transfer device 251. One of these components is a turret member, generally identified by the numeral 255. The turret member 255 is in the form of a plate 256 having a hollow boss 257 secured to the underside thereof and with a bore 258 extending therethrough. The plate 256 is provided with a plurality of bifurcated arms 260. In addition, the plate 256 is provided with crossing grooves 261 and 262 with the groove 261 being deeper than the groove 262.

The transfer device 251 also includes pairs of pocket assemblies with a typical pocket assembly being illustrated in FIG. 6 and being identified by the numeral 263. Each pocket assembly 263 includes a pair of remote pocket members 264 connected together by a spring loaded connector, generally identified by the numeral 265.

Each pocket member 264 is identical and has a pair of mounting arms 266 extending from one side thereof for engagement over an associated bifurcated arm 260 and for pivotal connection thereto by means of a pivot pin 267, as shown in FIG. 5. The pocket member is provided with a pair of can body socket defining plates 268 and a can body hold down plate 270 which are disposed remote from the spring connector 265. The inner part of each pocket member is configurated to define a lower socket 271 in which a cam follower 272 is seated. Above the lower socket 271 is an upper socket 273 in which an end of the associated spring connector 265 is positioned and which end is connected to the pocket member by means of a pin 274. It is to be understood that the upper sockets 273 are of sufficient height whereby spring connectors 265 may be arranged in crossing relation. The lowermost spring connector 265 will be seated in the deep groove 261 and the uppermost spring connector 265 will be seated in the shallow groove 262, as is clearly shown in FIG. 5.

Each spring connector 265 includes an elongated connector member 275 having an end portion in the form of an eye receiving one of the pins 274. The connector member 275 has an elongated opening 277 therethrough in which there is positioned a compression spring 278. A rod 280 extends into the end of the connector member 275 remote from the portion 276 with the rod being guided by a bushing 281 seated in the adjacent end of the connector member 275. The opposite end of the rod 280 extends into the end portion 276 of the connector member 275 and is provided with a collar 282. The spring 278 is compressed between the bushing 281 and the collar 282 with the spring 278 resisting the separation of the pocket members 264 of the respective pair.

Figure 3:
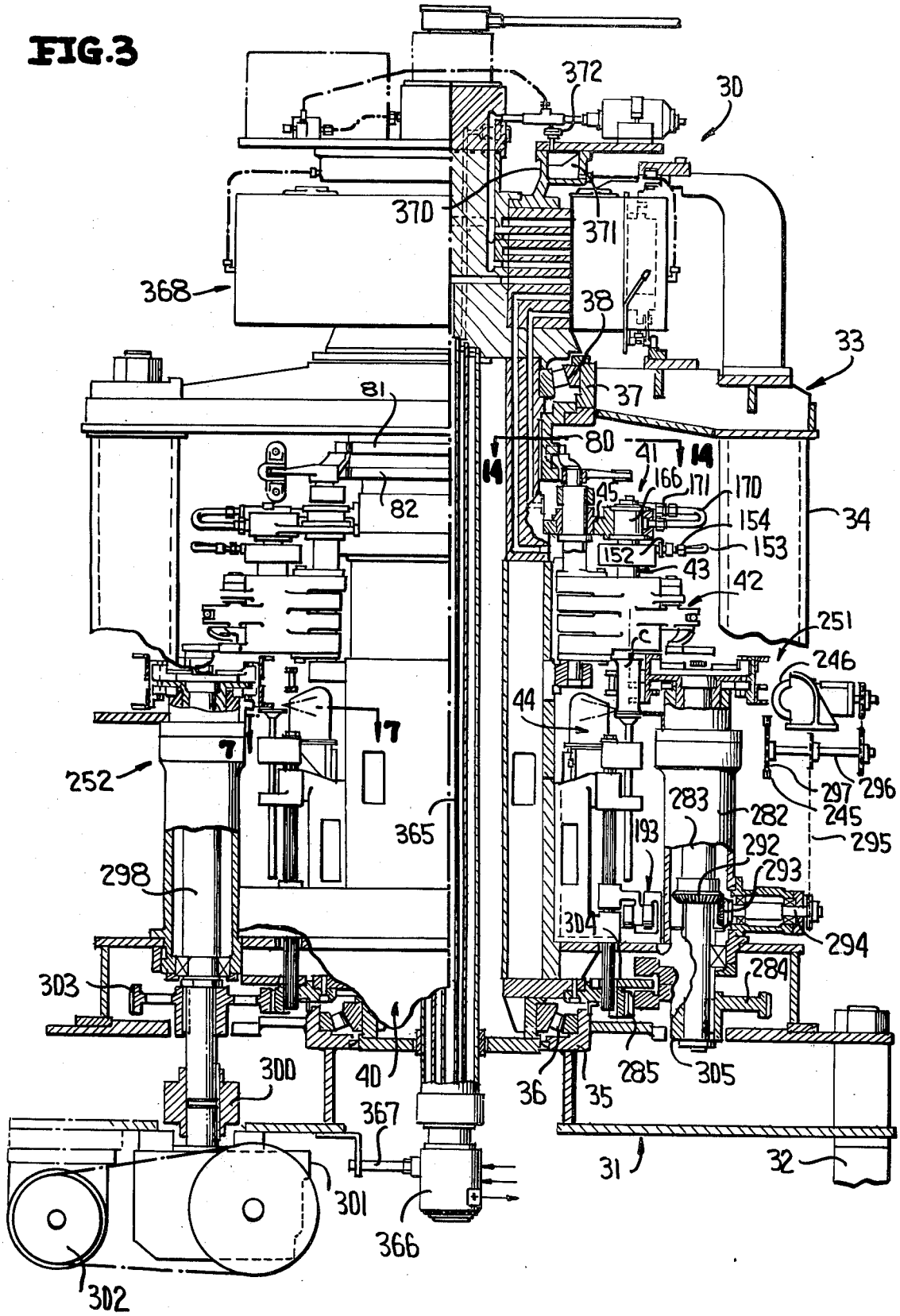
FIG. 3 is an elevational view of the machine with a portion thereof removed generally along the line 3—3 of FIG. 1 and shows the specific details of the machine.

Referring now to FIG. 3, it will be seen that the transfer device 251 includes a housing 282 which is suitably mounted on the base 31. The housing 282 has rotatably journalled therein a shaft 283 with the lower end of the shaft 283 carrying a pinion gear 284 which is meshed with a ring gear 285 secured to the central frame 40 for rotating the same in a manner to be described hereinafter.

Referring once again to FIG. 5, it will be seen that the housing 282 has secured to the upper end thereof an extension 286. The extension 286 is disposed about the boss or hub 257 of the turret member 255 and will be provided with suitable fittings for supplying lubricant to the interior thereof. Lubricant flows through passages in the housing extension 286 and then through lubricant lines to lubricate the pivot pins 267.

It is to be noted that the hub 255 is secured to the upper end of the shaft 283 by a suitable fastener 288 and a key 290 for rotation with the shaft 283.

It will also be seen that the housing extension 286 has mounted on the upper end portion thereof a cam 291 for engagement by the cam followers 272. As is clearly shown in FIG. 4, the cam 291 is of a configuration wherein while for the most part of their travel the pocket members 264 move in a circular path, this path is modified as the pocket members 264 approach the path 238 of travel of the body supports 113 and the path of travel of the pocket members 264 is that illustrated in FIG. 2 and identified by the numeral 240.

Returning once again to FIG. 3, it will be seen that there is illustrated the drive for the endless conveyor 245 and the feed screw 246. The shaft 283 has a double gear 292 mounted thereon and the same drives a gear 293 of a take off shaft 294. Through a sprocket and chain connection 295, the take off shaft 294 drives a shaft 296 which carries a sprocket 297 of the conveyor 245. The shaft 296 also drives the right angle drive unit 248 to drive the feed screw 246.

It is to be noted that the transfer device 252 is of a similar construction to the transfer device 251, but the auxiliary drive just described is not necessary. Further, it is to be noted that the transfer device 252 has a shaft 298 which corresponds to the shaft 283, but which extends down further into the base 31 and which is connected by a coupling 300 to a drive unit 301 which, in turn, is driven by a motor 302. Further, it is to be noted that the shaft 298 carries a pinion gear 303, which corresponds to the pinion gear 284, but which is the drive gear for the ring gear 285. Thus, the shaft 298 is directly driven from the power unit 301 and the pinion gear 303 drives the ring gear 285 which, in turn, drives the pinion gear 284.

An important feature of the machine is also illustrated in FIG. 3. It is to be noted that the ring gear 285 is carried by a ring member 304 and this ring member has associated therewith a brake caliper 305. There will be a plurality of such brake calipers 305 disposed circumferentially about the ring 304 and the ring 304 and the calipers 305 form what is commonly referred to as a disc brake.

In the past large machines have been driven in the customary manner illustrated herein. That is, the rotating component is provided with a ring gear, and the ring gear is driven through a pinion. Such a drive has been effective. However, in the past when the machines are equipped with a brake, the brake is normally incorporated with the motor or the drive unit with the result that when it is desired to stop the machine quickly in an emergency, there is an immediate lock up of the drive mechanism placing a great strain on the gears and shafts involved. In accordance with this invention, by utilizing a disc brake arrangement, these stresses have been eliminated. While the specific details thereof have not been illustrated herein and will not be described in further detail hereinafter, it is to be understood that in the conventional operation of the machine 30, when it is necessary to stop the operation of the machine, the motor 302 will be de-energized simultaneously with the energization of the calipers 305. Thus, there is never any undesirable opposed reaction between the brake system and the drive system.

Although only a preferred embodiment of the invention has been specifically illustrated and described herein, minor vibriations may be made in the machine and the numerous components thereof without departing from the spirit of the invention, as defined by the appended claims.

What is claimed as new:

1. A transfer device for transferring members to and from supports moving in an arcuate path, said transfer device comprising a turret member mounted for rotation about a fixed axis, a plurality of article carriers pivotally carried by said turret member for movement therewith in a generally circular path, and control means for controlling the contour of a portion of said generally circular path to correspond to the contour of said arcuate path, said control means including a fixed cam, spring loaded control arms connected to said articles carriers for positioning the same, cam follower means carried by said control arms riding on said cam to position said arms, control arms of opposite ones of said article carriers being interconnected by a connector, and said connectors being disposed in crossing relation and slidably mounted in said turret.

2. The transfer device of claim 1 wherein said spring loaded control arms react against said connectors.

* * * * *